US005193614A

United States Patent [19]

Cox

[11] Patent Number: 5,193,614

[45] Date of Patent: Mar. 16, 1993

[54] CABLE ANCHOR ASSEMBLY

[75] Inventor: Don C. Cox, Roanoke, Tex.

[73] Assignee: Otis Engineering Corporation, Dallas, Tex.

[21] Appl. No.: 661,517

[22] Filed: Feb. 26, 1991

[51] Int. Cl.[5] ..... E21B 17/042

[52] U.S. Cl. ..... 166/65.1; 166/105

[58] Field of Search ..... 166/65.1, 105, 106, 166/68, 385; 417/423.3, 422, 423.5

[56] References Cited

U.S. PATENT DOCUMENTS

| | | | |
|---|---|---|---|
| 3,411,454 | 11/1968 | Arutunoff | 417/423.3 |
| 4,648,444 | 3/1987 | Busch | 166/65.1 |
| 4,655,291 | 4/1987 | Cox | 166/385 |
| 4,725,783 | 2/1988 | Miyairi et al. | 166/65.1 X |
| 4,749,341 | 6/1988 | Baugh, III | 417/360 |
| 4,804,050 | 2/1989 | Kerfoot | 175/20 |
| 4,913,239 | 4/1990 | Baugh, III | 166/65.1 X |

OTHER PUBLICATIONS

Baugh, III et al., "Completion Capabilities of a New Cable Deployed Electric Submersible Pumping System for Enchanced Oil Production", May 1989.

*Primary Examiner*—Hoang C. Dang

*Attorney, Agent, or Firm*—Ross, Howison, Clapp & Korn

[57] ABSTRACT

A cable anchor assembly (16) for an inverted, cable deployed submersible pump (28) that comprises a cable tensioning device (18) adapted to preload the multiwire rope members (38) of the power cable (30). The cable tensioning device (18) comprises threaded upper (32), middle (34) and lower (36) sleeves, and the length of the device is manually adjustable by rotating the middle sleeve (34) relative to the upper (32) and lower (36) sleeves to increase or decrease tension on the multiwire rope members (38) of the power cable (30) as desired. The longitudinal bore (42) of the cable tensioning device (18) is adapted to accommodate and protect power delivery members (40) that extend through the bore for connection to the prime mover of the submersible pump.

19 Claims, 4 Drawing Sheets

CABLE ANCHOR ASSEMBLY

BACKGROUND OF THE INVENTION

1. Technical Field

This invention relates to cable anchors for cable deployed submersible pump systems, and more particularly, to a cable anchoring system comprising a device adapted to maintain tension on the power cable when connected to the motor of an inverted electric submersible pump.

2. Description of the Relevant Art

Prior art submersible well pumps and completion systems are disclosed, for example, in U.S. Pat. Nos. 4,749,341 and 4,913,239.

The use of multiconductor, multiwire rope cables for deploying and supplying electrical power to submersible pumps has previously been recognized as a more cost-effective alternative to conventional tubing deployment in many production situations. Cable deployment combines the advantages of faster installation and retrieval with smaller workover equipment. Methods and apparatus for use in cable deployed pumping systems are generally discussed in "Completion Capabilities Of A New Cable Deployed Electric Submersible Pumping System For Enhanced Oil Production," paper No. 89-40-13 of Petroleum Society of CIM (presented in May 1989), which is incorporated by reference in this application. Apparatus for injecting coil tubing, adaptable for use in injecting power cable when deploying submersible pumps, is disclosed in U.S. Pat. No. 4,655,291.

To mechanically attach the electrical support cable to the cable-deployed components, a cable anchor is required. Drum sockets or helical splice rod terminations are well known means for securing multiwire ropes in conventional cable anchor assemblies suitable for use with inverted electric submersible pumps. The electrical conductors typically extend outwardly through a port in the body of the cable anchor assembly and are connected to the motor above the inverted pump.

SUMMARY OF THE INVENTION

The present invention discloses a cable anchor assembly that comprises means for tensioning and protecting the power cable following connection to the prime mover of an inverted submersible pump.

According to one embodiment of the invention, a cable anchor assembly is provided that is adapted to support and deliver motive power to an inverted, cable deployed submersible pump system, and to protect the power cable. The subject cable anchor assembly preferably comprises a tensioning device adapted to preload the multiwire ropes at the lower end of the power cable. Electrical conductors in the power cable are preferably routed longitudinally through the tensioning device and connected to an electric motor disposed above the submersible pump.

According to another embodiment of the invention, a cable anchoring device is provided that comprises a tensioning device having cooperatively threaded upper, middle and lower sleeves. The length of the tensioning device is adjustable to selectively preload the multiwire ropes within a power cable by rotating the middle sleeve relative to the upper and lower sleeves. Means are preferably provided for rotating the middle sleeve relative to the upper and lower sleeves, and for limiting the rotation of the middle sleeve relative to the upper and lower sleeves once the multiwire ropes are preloaded to the desired tension.

According to another embodiment of the invention, a system is provided for deploying an inverted submersible pump in a subterranean well. The system of the invention preferably comprises an inverted submersible pump, a power cable having at least one multiwire rope cable and at least one means for delivering motive power to the pump, and a cable anchor assembly adapted to be deployed with the pump in the well. The cable anchor assembly of the system preferably further comprises a longitudinal bore adapted to receive the power cable, means for anchoring the multiwire rope cable, means for connecting the motive power delivery means to the pump, and a tensioning device adapted to preload the multiwire rope cable. The tensioning device preferably comprises cooperatively threaded upper, middle and lower sleeves, and the length of the tensioning device is preferably adjustable by rotation of the middle sleeve relative to the upper and lower sleeves to selectively increase or decrease tension on the multiwire rope cable.

BRIEF DESCRIPTION OF THE DRAWINGS

The apparatus of the invention is further described and explained in relation to the following figures of the drawings in which.

Like reference numerals are used to designate like parts in all figures of the drawings.

DESCRIPTION OF THE PREFERRED EMBODIMENTS

Figure 1:
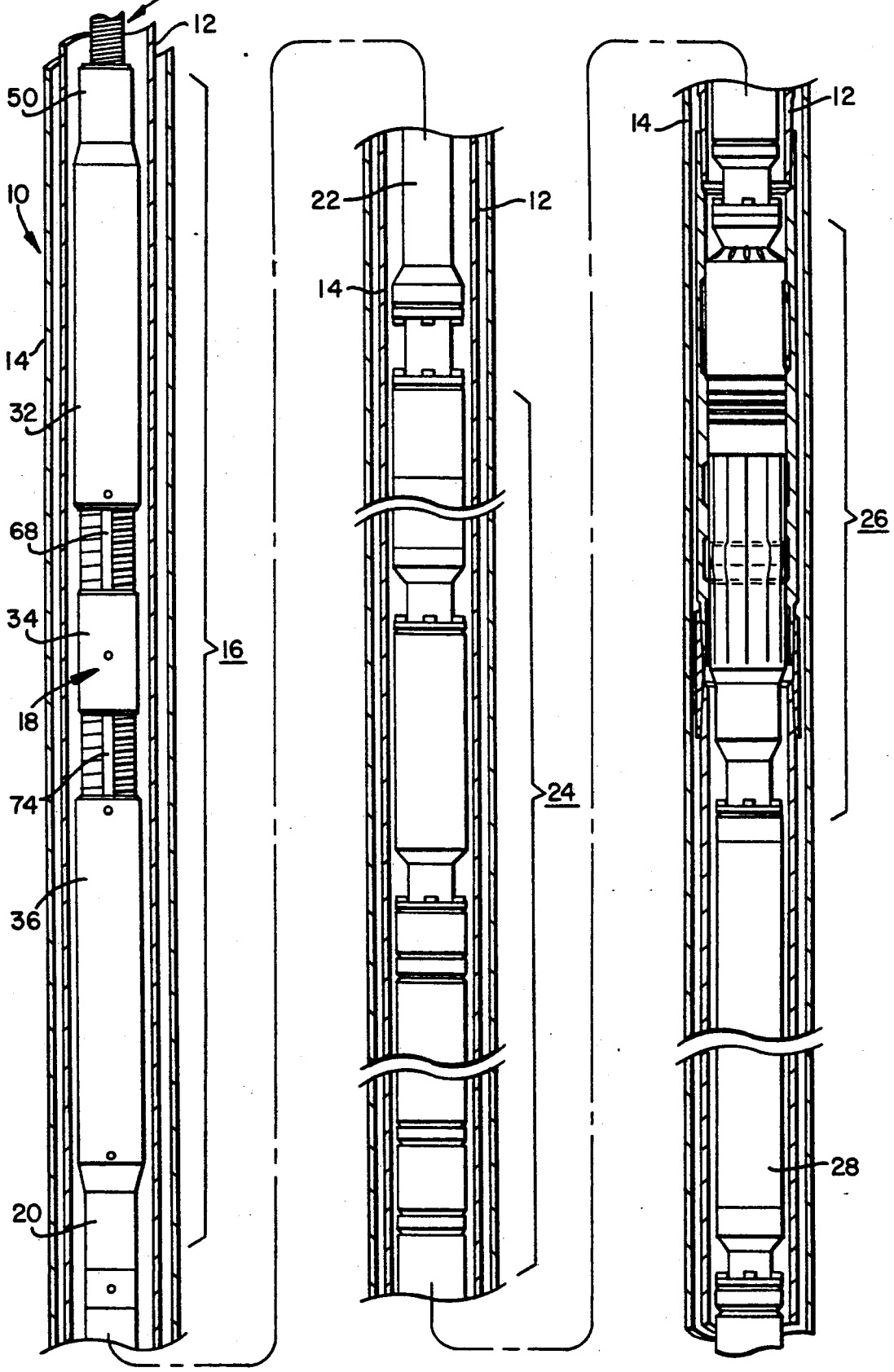
FIG. 1 is a schematic view, partially in longitudinal section, partially in elevation, and partially broken away, showing a well completion with an inverted submersible pump and related downhole equipment.

Referring to FIG. 1, cable deployed pumping system 10 is shown in schematic form, partially segmented and partially broken away for illustrative purposes. System 10 is disposed inside production tubing 12, which is in turn disposed within casing 14. System 10 preferably further comprises cable anchor assembly 16, electrical penetrator assembly 22, motor assembly 24, locking module discharge head assembly 26, and pump 28, all of which are supported during deployment in a 10 subterranean well by power cable 30. Cable anchor assembly 16 preferably further comprises tensioning device 18 and shear release sub 20. Tensioning device 18 preferably further comprises upper sleeve 32, middle sleeve 34, and lower sleeve 36. Other related downhole equipment including, for example, the pump intake, pump protector, packer and the like are well known, are not needed to describe the invention disclosed herein, and are accordingly not shown in FIG. 1.

Cable anchor assembly 16 of the invention is further described and explained in relation to FIGS. 2A, 2B, 2C, 2D and 3 of the drawings. FIGS. 2A, 2B, 2C and 2D are enlarged elevational views, partially in section, that sequentially depict the structure of cable anchor assembly 16 in greater detail than is shown in FIG. 1.

Figure 2A:
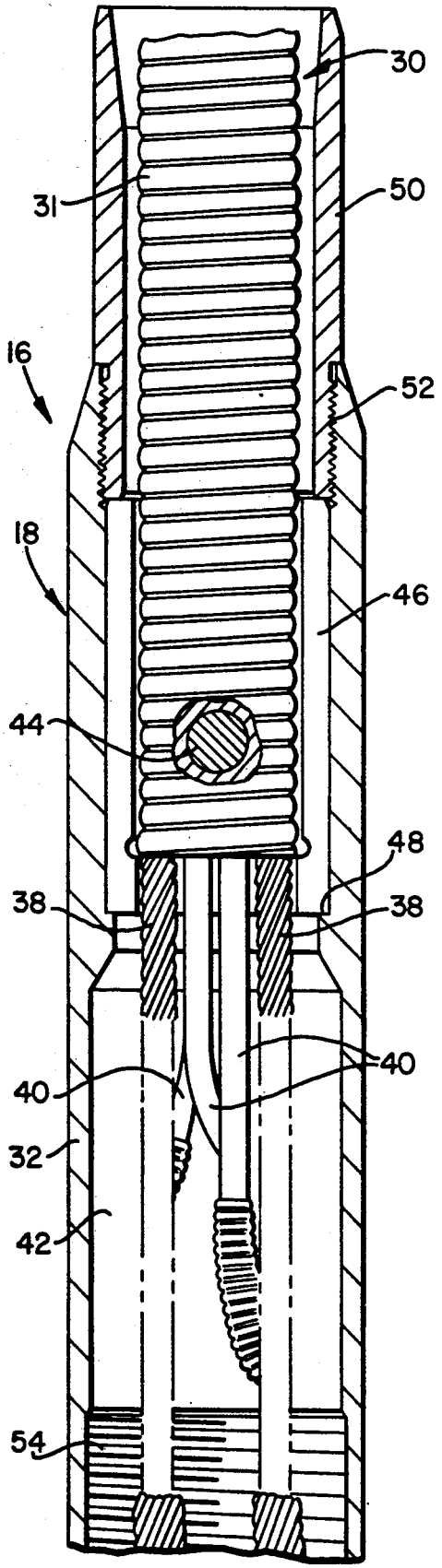
FIGS. 2A, 2B, 2C, and 2D are sequentially broken detail views, partially in longitudinal section, showing the cable anchor assembly of the invention.

Referring to FIG. 2A, upper sleeve 32 of tensioning device 18 is adapted by means of longitudinal bore 42 to accommodate power cable 30. In the bottom half of FIG. 2A, corrugated steel sheathing 31 of power cable 30 is removed to reveal multiwire rope cables 38 and electrical conductors 40. Power cable 30 is preferred for use in system 16 of the invention whenever the prime mover for submersible pump 28 is an electric motor. It is understood, however, that power cables comprising hydraulic lines can also be employed if desired where the prime mover of the pump is hydraulically rather than electrically powered.

Figure 4:
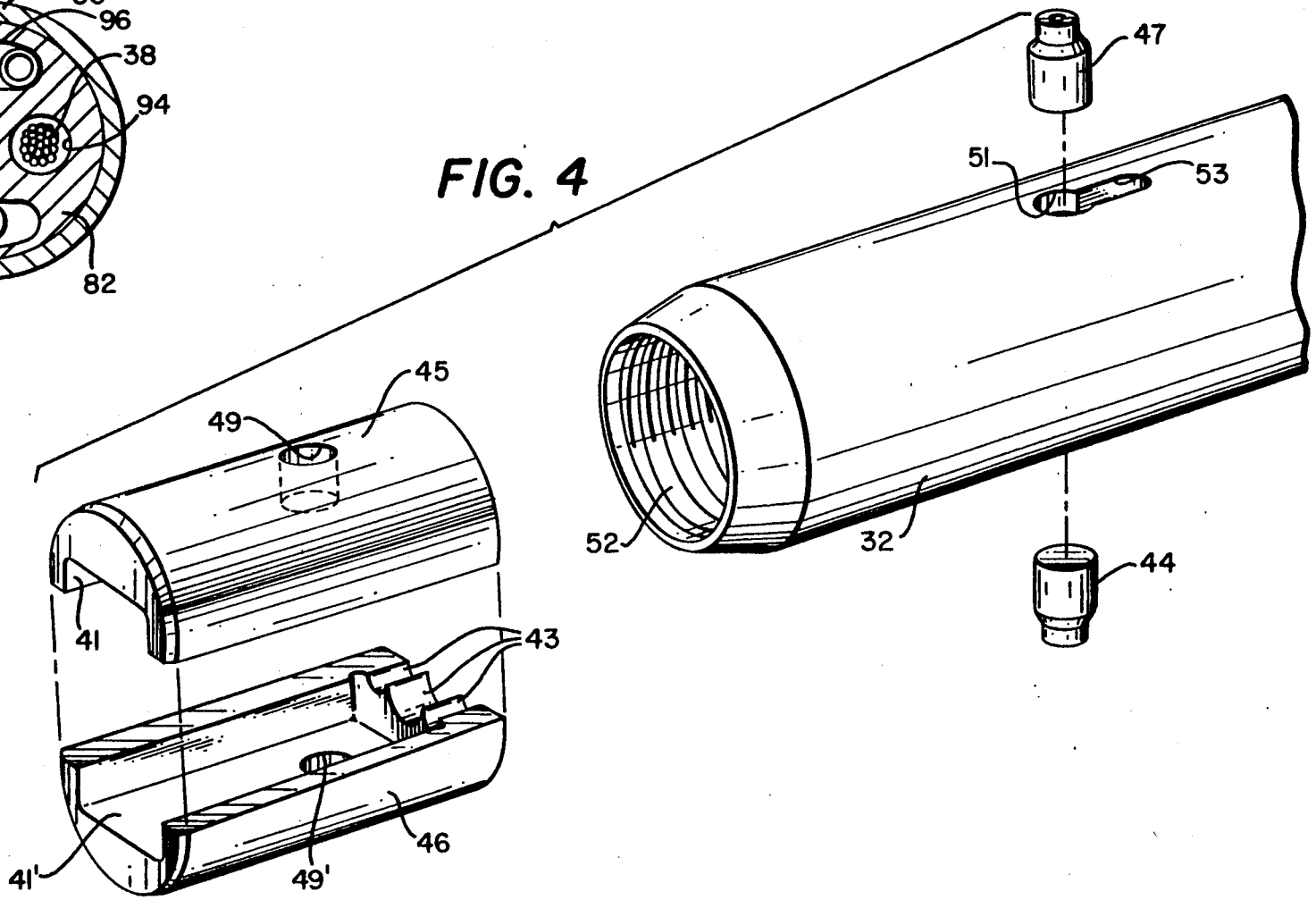
FIG. 4 is an enlarged, exploded perspective detail view provided for use in further describing and explaining the structure shown in FIG. 2A.

Preferred means for securing power cable 30 inside upper sleeve 32 are further described and explained with reference to FIGS. 2A and 4. FIG. 4 is an exploded detail view depicting cable retainers 45, 46 that cooperate to capture power cable 30 therebetween. During assembly of cable anchor assembly 16, power cable 30 is routed between cable retainers 45, 46 prior to inserting cable retainers 45, 46 into upper sleeve 32. Steel sheathing 31 of power cable 30 fits inside cavities 41, 41', and rope cables 38 and electrical conductors 40 are secured between shoulders 43 of cable retainer 46 and opposing shoulders (not visible in FIG. 4) of cable retainer 45. When upper sleeve 32 is extended to place rope cables 38 in tension, pins 44, 47 are inserted through diametrically opposed holes in upper sleeve 32. (One such hole 51 is visible in FIG. 4.) When blind holes 49, 49' of cable retainers 45, 46 are aligned with the holes in upper sleeve 32, pins 47, 44 are inserted therein. Further extension of upper sleeve 32 causes the reduced diameter sections of pins 47, 44 to engage the narrower slots adjacent to the holes in upper sleeve 32 (as depicted by slot 53 in FIG. 4), preventing pins 47, 44 from falling out, and also preventing rotation of cable retainers 45, 46 within upper sleeve 32. This also serves to prevent rotation and twisting of the cable relative to the anchor. Cable retainers 45, 46 abut internal annular shoulder 48 of upper sleeve 32 of tensioning device 18, as shown in FIG. 2A. Upper sleeve 32 engages sub 50 by means of threads 52.

Figure 2B:
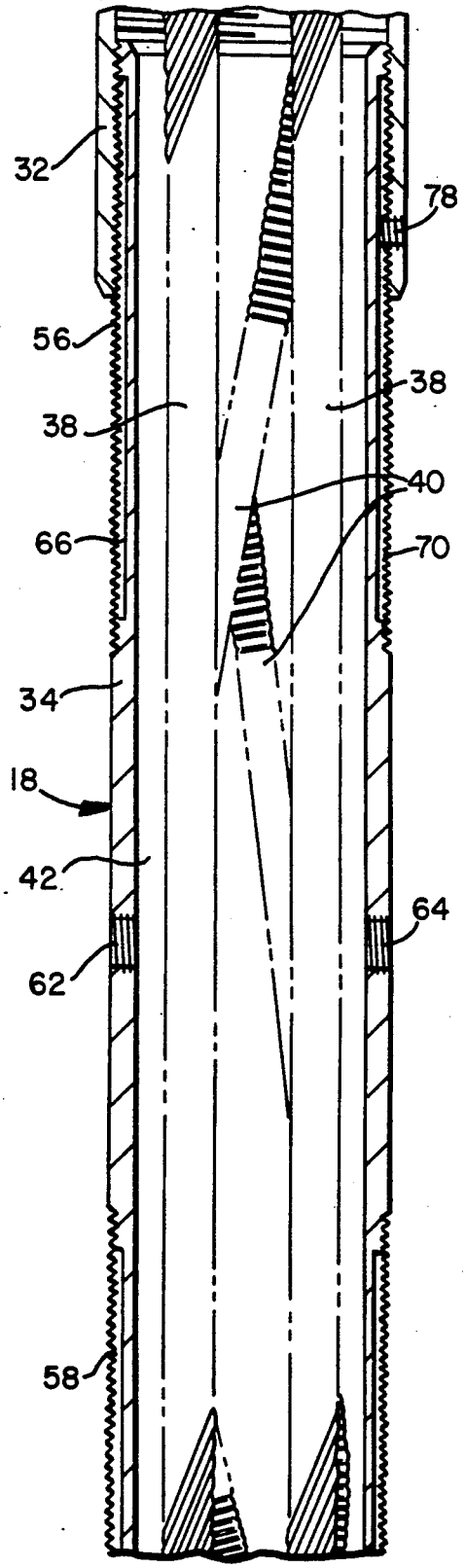
Figure 2C:
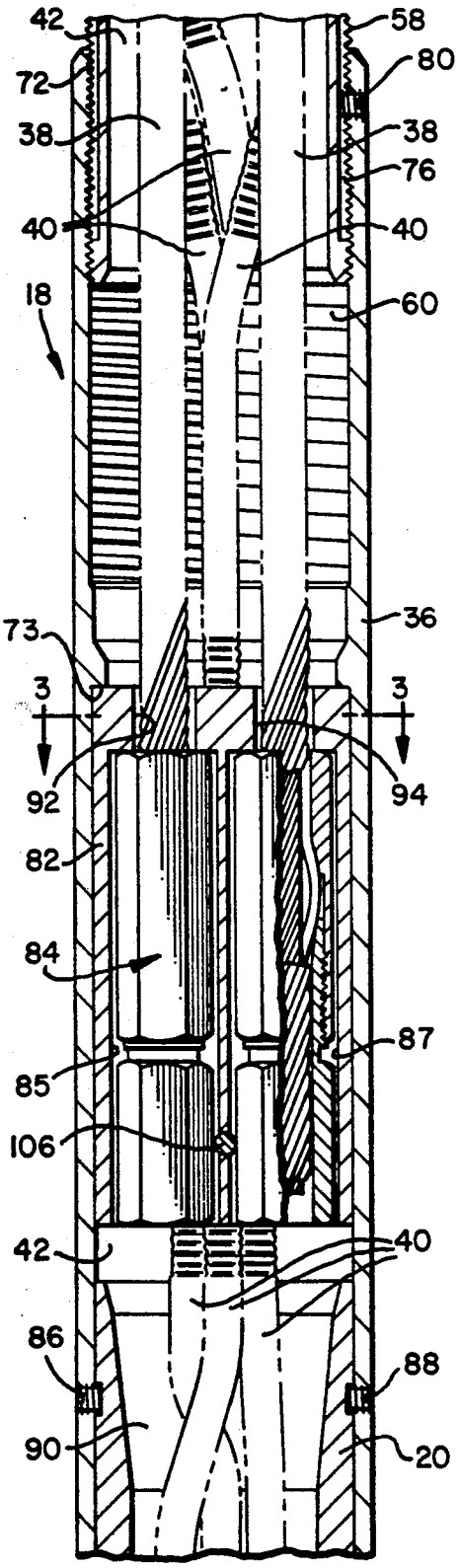

As shown in FIG. 2B, internal threads 54 of upper sleeve 32 are adapted to engage external threads 56 at the upper end of middle sleeve 34 of tensioning device 18. External threads 58 are likewise provided at the lower end of middle sleeve 34 for threaded engagement with internal threads 60 at the upper end of lower sleeve 36 as shown in FIG. 2C. External threads 56, 58 are preferably oppositely threaded, and internal threads 54, 60 are preferably correspondingly threaded, so that rotation of middle sleeve 34 relative to upper sleeve 32 and lower sleeve 36 will cause tensioning device 18 to be selectively lengthened or shortened as desired. Radially extending tapped holes 62, 64 are desirably provided for threaded engagement with removable handles (not shown) that can be used to rotate middle sleeve 34 relative to upper sleeve 32 and lower sleeve 36 during make-up of cable anchor assembly 16 at the surface prior to deployment in the well.

As shown in FIGS. 1, 2B and 2C, a plurality of circumferentially spaced, longitudinally extending flats 66, 68, 70, 72, 74 and 76 are desirably provided in external threads 56, 58 of middle sleeve 34. These flats cooperate with set screws 78, 80 shown in FIGS. 2B, 2C, respectively, to limit rotation of middle sleeve 34 relative to upper sleeve 32 and lower sleeve 36 of tensioning device 18 once the desired degree of tension in multiwire rope cables 38 has been achieved.

Referring to FIG. 2B, it is seen that longitudinal bore 42 extends through middle sleeve 34, thereby accommodating rope cables 38 and electrical conductors 40.

Figure 3:
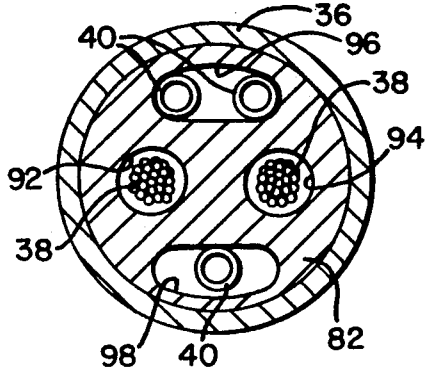
FIG. 3 is a cross-sectional view taken along line 3—3 of FIG. 2C.

Referring to FIGS. 2C and 3, load transfer sub 82 is inserted into bore 42 through the lower end of lower sleeve 36, and is adapted to receive conventional rope cable terminators 84. During make-up of cable anchor assembly 16 prior to deployment, middle sleeve 34 is desirably rotated so as to shorten the distance between upper sleeve 32 and lower sleeve 36, thereby shortening the overall length of tensioning device 18. Multiwire rope cables 38 are passed through bore 42 of lower sleeve 36 and through orifices 92, 94 of load transfer sub 82. After rope cable terminators 84 are attached to rope cables 38, rope cable terminators 84 are nested inside bores 85, 87 of load transfer sub 82, and load transfer sub inserted into the lower end of lower sleeve 36. As middle sleeve 34 is oppositely rotated to lengthen the distance between upper sleeve 32 and lower sleeve 36, load transfer sub 82 bears against annular interior shoulder 73 of lower sleeve 36. In this manner, multiwire rope cables 38 are preloaded in tension, and the mechanical load is transferred from rope cables 38 to lower sleeve 36 through cable terminators 84 and load transfer sub 82. Spring pin 106 is provided to prevent relative rotational motion between load transfer sub 82 and cable terminators 84.

Figure 2D:
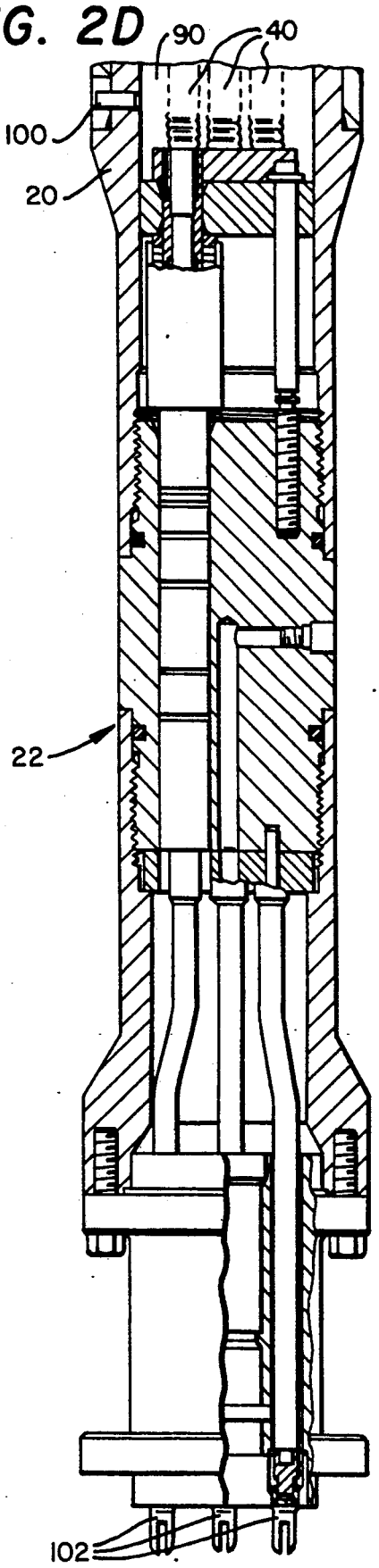

Referring to FIGS. 2C and 2D, shear release sub 20 preferably slidably engages the lower portion of bore 42 of lower sleeve 36. Shear release sub 20 is inserted into lower sleeve 36 of tensioning device 18 after the insertion of load transfer sub 82 and cable terminators 84. Circumferentially spaced shear screws 86, 88 are illustrative of a plurality of such screws that are desirably provided to facilitate forced separation of tensioning device 18 from shear release sub 20 when such separation is operationally necessary. At least one spring pin 100 is desirably provided to limit torsional loading on shear screws 86, 88.

The lower end of shear release sub 20 preferably threadedly engages electrical penetrator assembly 22, which comprises electrical connectors 102 adapted to connect electrical conductors 40 to motor assembly 24.

Other alterations and modifications of the invention disclosed herein will likewise become apparent to those of ordinary skill in the art upon reading this disclosure, and it is intended that the scope of the invention be limited only by the broadest interpretation of the appended claims to which the inventor is legally entitled.

I claim:

1. A cable anchor assembly adapted to support and protect a power cable delivering motive power to an inverted, cable deployed submersible pump system in a subterranean well, and power cable comprising at least one support cable and at least one motive power delivery means, said cable anchor assembly comprising:

a. threaded upper, middle and lower sleeves each having a longitudinal bore extending therethrough, the middle sleeve comprising one end having left hand threads and one end having right hand threads;

b. means for anchoring the power cable in the longitudinal bore of the upper sleeve;

c. means for anchoring the support cable in the longitudinal bore of the lower sleeve; and d. length adjustment means for selectively adjusting the spacing between the anchoring means in the upper sleeve and the anchoring means in the lower sleeve.

2. The cable anchor assembly of claim 1 wherein the support cable comprises two multiwire rope cables and means for anchoring each such multiwire rope cable in the longitudinal bore of the lower sleeve.

3. The cable anchor assembly of claim 1 wherein the middle sleeve comprises means for receiving removable means for selectively rotating the middle sleeve relative to the upper and lower sleeves.

4. The cable anchor assembly of claim 1 further comprising means for selectively maintaining a desired spacing between the anchoring means in the upper sleeve and the anchoring means in the lower sleeve.

5. The cable anchor assembly of claim 1, further comprising: shear release means comprising means for slidably engaging the lower sleeve opposite the middle sleeve and having a longitudinal bore communicating with the longitudinal bore of the lower sleeve; and a plurality of circumferentially spaced shear screws interconnecting the lower sleeve and the shear release means.

6. The cable anchor assembly of claim 5, further comprising at least one means for limiting torsional loading on the shear screws.

7. The cable anchor assembly of claim 6 wherein the means for limiting torsional loading on the shear screws comprises at least one spring pin.

8. The cable anchor assembly of claim 5 wherein the shear release means comprises a lower end further comprising means for threadedly engaging an electrical penetrator assembly.

9. A system for deploying an inverted submersible pump in a subterranean well, said system comprising:

a. an inverted submersible pump and cable means for lowering the pump into the well;

b. the cable means comprising a power cable further comprising at least one multiwire rope cable and at least one means for delivering motive power to the pump; and c. a cable anchor assembly disposed above the pump in the well, the cable anchor assembly further comprising:

(i) threaded upper, middle and lower sleeves each having a longitudinal bore extending therethrough, the middle sleeve comprising one end having left hand threads and one end having right hand threads;

(ii) means for anchoring the power cable in the longitudinal bore of the upper sleeve;

(iii) means for anchoring the support cable in the longitudinal bore of the lower sleeve; and (iv) length adjustment means for selectively adjusting the spacing between the anchoring means in the upper sleeve and the anchoring means in the lower sleeve.

10. The system of claim 9 wherein the support cable comprises two multiwire rope cables and the cable anchor assembly comprises means for anchoring each such multiwire rope cable in the longitudinal bore of the lower sleeve.

11. The system of claim 9 wherein the pump comprises an electric motor and the motive power delivery means comprises a plurality of electrical conductors.

12. The system of claim 9 wherein the middle sleeve comprises means for receiving removable means for selectively rotating the middle sleeve relative to the upper and lower sleeves.

13. The system of claim 9 further comprising means for selectively maintaining a desired spacing between the anchoring means in the upper sleeve and the anchoring means in the lower sleeve.

14. The system of claim 9 wherein the means for delivering motive power to the pump comprises at least one electrical conductor.

15. The system of claim 9 wherein the means for delivering motive power to the pump comprises at least one hydraulic line.

16. The system of claim 9 wherein the cable anchor assembly further comprises: shear release means comprising means for slidably engaging the lower sleeve opposite the middle sleeve and having a longitudinal bore communicating with the longitudinal bore of the lower sleeve; and a plurality of circumferentially spaced shear screws interconnecting the lower sleeve and the shear release means.

17. The system of claim 16 wherein the cable anchor assembly further comprises at least one means for limiting torsional loading on the shear screws.

18. The system of claim 17 wherein the means for limiting torsional loading on the shear screws comprises at least one spring pin.

19. The system of claim 16, further comprising an electrical penetrator assembly, wherein the shear release means comprises a lower end further comprising means for threadedly engaging the electrical penetrator assembly.

* * * * *